US008402597B2

(12) United States Patent
Rosenzweig et al.

(10) Patent No.: US 8,402,597 B2
(45) Date of Patent: Mar. 26, 2013

(54) STEAM APPLIANCE WITH MOTION SWITCH

(75) Inventors: Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 533 days.

(21) Appl. No.: 12/617,518

(22) Filed: Nov. 12, 2009

(65) Prior Publication Data

US 2010/0116298 A1 May 13, 2010

Related U.S. Application Data

(60) Provisional application No. 61/114,269, filed on Nov. 13, 2008.

(51) Int. Cl.

| | |
|---|---|
| ***A47L 7/00*** | (2006.01) |
| ***A47L 9/00*** | (2006.01) |
| ***B08B 5/00*** | (2006.01) |
| ***D06F 75/10*** | (2006.01) |

(52) U.S. Cl. ..... 15/339; 15/320; 38/77.7

(58) Field of Classification Search ..... 15/320, 15/339; 38/77.7

See application file for complete search history.

(56) References Cited

U.S. PATENT DOCUMENTS

| | | | | |
|---|---|---|---|---|
| 2,674,054 | A | | 4/1954 | Maykemper |
| 2,700,236 | A | | 1/1955 | Marvin et al. |
| 2,749,633 | A | | 6/1956 | Seck |
| 2,750,695 | A | | 6/1956 | Swenson |
| 3,050,885 | A | | 8/1962 | Whitfield |
| 3,074,192 | A | | 1/1963 | Smith |
| 3,986,282 | A | | 10/1976 | Nelson |
| 4,577,424 | A | | 3/1986 | Liu |
| 4,688,025 | A | * | 8/1987 | Frank ..... 340/571 |
| 4,837,952 | A | | 6/1989 | Hennuy et al. |
| 5,121,464 | A | | 6/1992 | Hanada et al. |
| 5,512,728 | A | | 4/1996 | Jalbert |
| 5,751,074 | A | | 5/1998 | Prior et al. |
| 5,966,851 | A | | 10/1999 | Serpa |
| 6,249,996 | B1 | | 6/2001 | Dorber et al. |
| 6,453,587 | B1 | | 9/2002 | Alipour |

(Continued)

FOREIGN PATENT DOCUMENTS

| | | | |
|---|---|---|---|
| EP | 1 801 281 | A1 | 6/2007 |
| JP | 2006255148 | A * | 9/2006 |

(Continued)

OTHER PUBLICATIONS

Invitation to Pay Additional Fees for PCT/US2009/064401 mailed Feb. 18, 2010.

(Continued)

*Primary Examiner* — Bryan R Muller

(74) *Attorney, Agent, or Firm* — Wolf, Greenfield & Sacks, P.C.

(57) ABSTRACT

A steam appliance having a water pump controlled by a motion switch response to movement of the appliance is provided. In one embodiment, a micro-switch is turned ON and OFF by movement of a micro-switch actuator in operative engagement with the towel frame at the base if the appliance. In another embodiment, the actuator is operatively connected to a mechanical pump to activate the pump. The motor switch or actuator will be displaced whenever the unit is moved by a user, thus causing the pump to pump water to the boiler. Steam is then fed to a steam pad that may have a replaceable fabric pad fit snugly on the frame to distribute clean steam to a surface to be steamed.

8 Claims, 9 Drawing Sheets

U.S. PATENT DOCUMENTS

| | | | | |
|---|---|---|---|---|
| 6,674,028 | B1 * | 1/2004 | Berton | 200/61.52 |
| 6,925,738 | B2 | 8/2005 | Alipour | |
| 7,562,474 | B2 | 7/2009 | Voitchovsky | |
| 7,930,798 | B2 | 4/2011 | Zhou et al. | |
| 8,056,272 | B2 | 11/2011 | Rosenzweig et al. | |
| 2002/0020085 | A1 | 2/2002 | Kobayashi et al. | |
| 2005/0278987 | A1 * | 12/2005 | Ching et al. | 38/77.5 |
| 2008/0066789 | A1 | 3/2008 | Rosenzweig et al. | |
| 2008/0236635 | A1 | 10/2008 | Rosenzweig et al. | |
| 2009/0000051 | A1 | 1/2009 | Rosenzweig et al. | |
| 2009/0223540 | A1 | 9/2009 | Rosenzweig et al. | |
| 2010/0037495 | A1 | 2/2010 | Rosenzweig et al. | |
| 2010/0040489 | A1 | 2/2010 | Rosenzweig et al. | |
| 2010/0058624 | A1 | 3/2010 | Voitchovsky | |
| 2010/0088932 | A1 * | 4/2010 | Rosenzweig et al. | 38/77.8 |

FOREIGN PATENT DOCUMENTS

| | | | |
|---|---|---|---|
| JP | 2007-313115 | A | 12/2007 |
| WO | WO 98/49385 | A1 | 11/1998 |
| WO | WO 01/55496 | A2 | 8/2001 |
| WO | WO 2008/016761 | A2 | 2/2008 |
| WO | WO 2008016741 | A2 | 2/2008 |
| WO | WO 2008078867 | A1 * | 7/2008 |

OTHER PUBLICATIONS

International Search Report and Written Opinion for PCT/US2009/053803 mailed Jan. 15, 2010.

International Search Report and Written Opinion for PCT/US2009/060834 mailed Jan. 21, 2010.

International Search Report mailed Apr. 21, 2010 for PCT/US2009/064401.

* cited by examiner

STEAM APPLIANCE WITH MOTION SWITCH

CROSS REFERENCE TO RELATED APPLICATIONS

This application is based on and claims the benefit of U.S. provisional application No. 61/114,269 filed on Nov. 13, 2008, the contents of which are incorporated herein by reference.

BACKGROUND OF THE INVENTION

The invention relates generally to a steam appliance, and more particularly to a steam appliance including a water pump and motion switch that is user actuated by movement of the appliance to pump water from a reservoir to a boiler for generating steam.

Steaming devices used to apply steam to household objects are well known. The uses of the devices vary widely, and may include the application of steam to drapes or other fabrics to ease wrinkles, and the application of steam to objects to assist in cleaning the various objects and surfaces.

In general, nozzles used with the steam appliances do not have large surface areas and a cloth or fabric pad is placed over a steam frame to provide a steaming or cleaning surface. The fabric pad may have Velcro strips to secure to cleats on the nozzle. Alternatively, a fabric steam pocket may be placed around a flat frame with baffles in order to increase the cleaning surface area.

Recently steam appliances have been developed where water is pumped from a reservoir to a boiler by the push-pull movement of the appliance handle. This actuates a bellows pump or piston pump operatively connected directly to the handle. These features are shown and described in parent application Ser. No. 11/496,143 and Ser. No. 11/769,525, the contents of which are incorporated here by reference in their entirety.

Notwithstanding the wide variety of steam appliances available remains desirable to provide additional steam products having improved ease of use and ways to pump water from the reservoir to the steam boiler.

SUMMARY OF THE INVENTION

Generally speaking, in accordance with the invention, a steam appliance having a water pump for selectively pumping water from a reservoir to a boiler for generation of steam in response to a user action is provided. The user actuates the pump by movement of the appliance to activate a motion switch or micro-switch, in response to either a forward movement, a downward pressure or a backward movement. The steam appliance includes a housing with a user handle and a towel frame or cleaning pad where the generated steam is distributed for steaming. Water is pumped by an electric pump, a mechanical or systolic pump closing a motion switch timer or circuit, or by mechanical movement of a pump piston or wheel. A steam frame for distributing steam generated in the boiler may be connected to the base of the appliance, such as a steam mop, steam brush, or steam iron. A fabric steam pad is mounted on the steam frame to distribute steam to the fabric to provide an improved steaming surface.

Accordingly, it is an object of the invention to provide an improved steam appliance.

Another object of the invention is to provide a steam appliance that pumps water to a steam generator in response to movement of the appliance.

A further object of the invention is to provide an improved steam appliance wherein movement of the appliance actuates a motion switch to cause water to be pumped from a reservoir to a boiler.

Yet another object of the invention is to provide a steam appliance with an electrical pump that is actuated by a motion switch when the appliance is moved during use.

Still another object of the invention is to provide a steam appliance with a mechanical pump activated by a motor to pump water to a steam generator in response to movement of a pump actuator.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
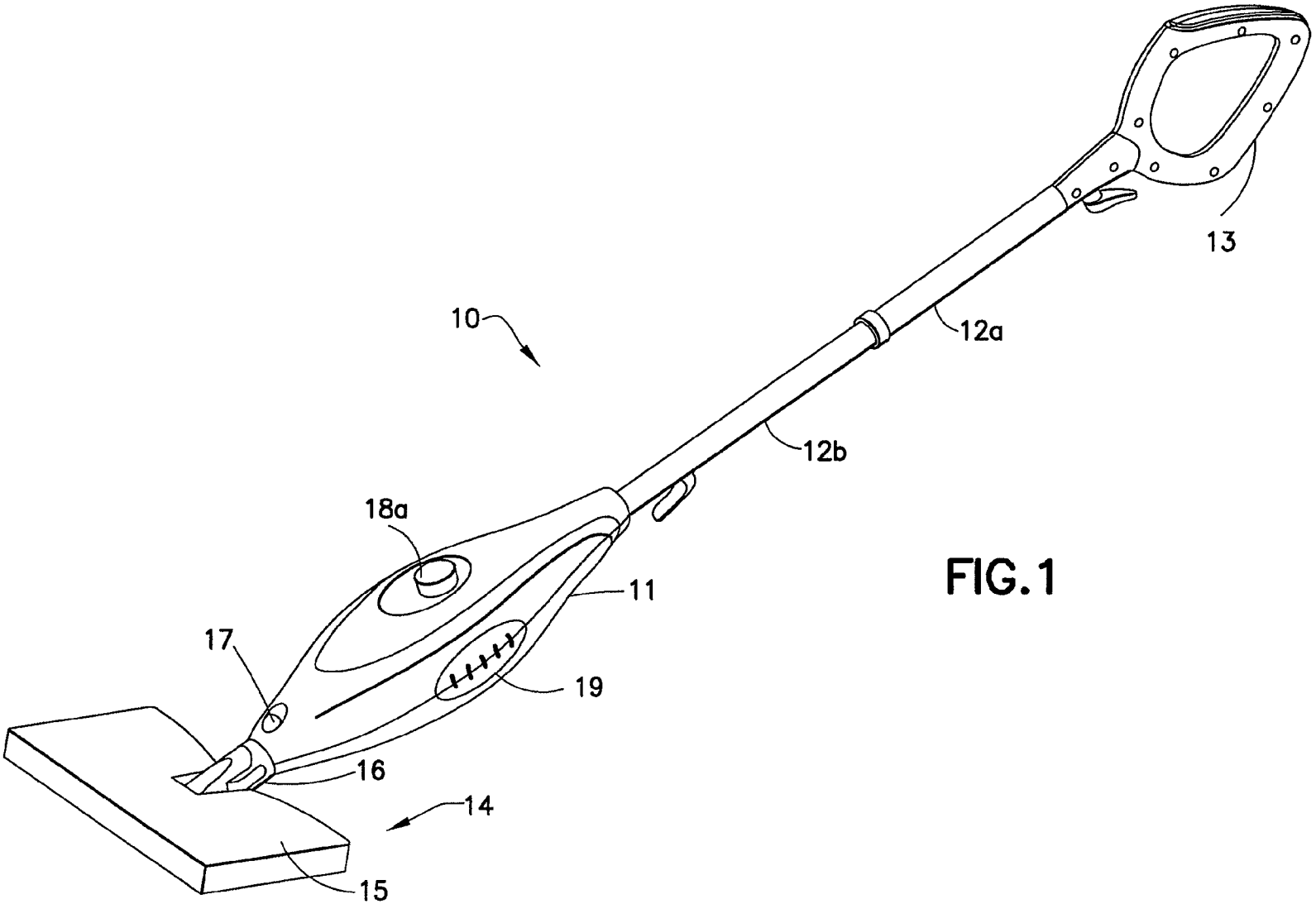
FIG. 1 is a perspective view of a steam mop with motion switch constructed and arranged in accordance with the invention.
Figure 2:
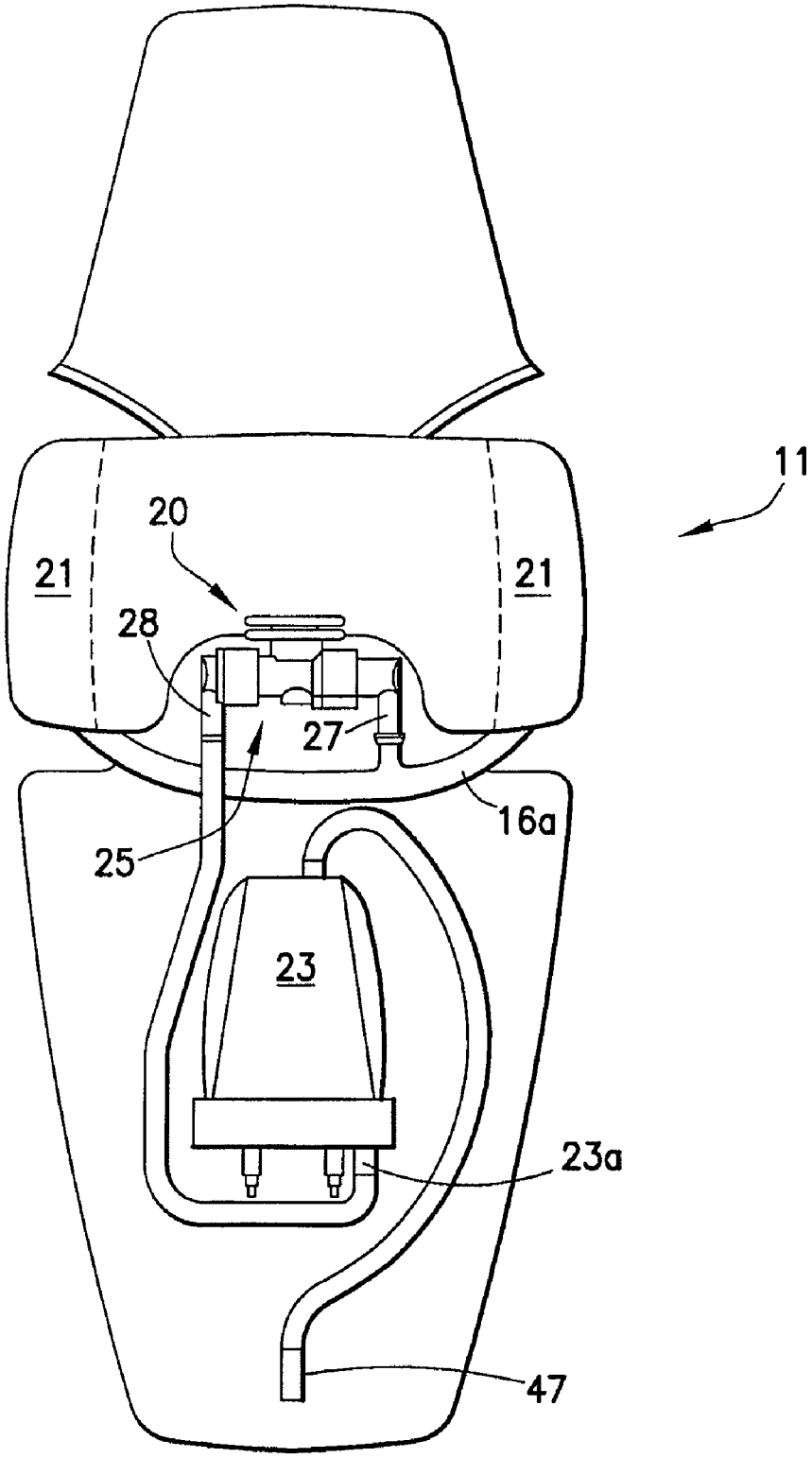
FIG. 2 is a front elevational view of the elements in the mop housing of FIG. 1 showing a reservoir, an electric pump with motion switch and a boiler.

FIG. 1 is a perspective view of a steam mop 10 constructed and arranged in accordance with the invention. Mop 10 includes an elongated housing 11 with a water reservoir 21 and a boiler 23 and an upper tube 12*a* and a lower tube 12*b* connected to one end of housing 11. A handle 13 is attached to the end of upper tube 12*a*. A steam frame 14 with an installed steam pocket 15 is operatively connected to the other end of housing 11 by a connector 16. In this embodiment, connector 16 and frame 14 may be removed from housing 11 by pressing a release button 17 at the base of housing 11. Water is introduced into a reservoir 21 at a water inlet or opening 18*a*. The level of water present in a reservoir 21 in housing 11 shown in FIG. 3 can be viewed through a sighting window 19. The specifics of fabric steam pocket 15 will be described below.

Figure 3:
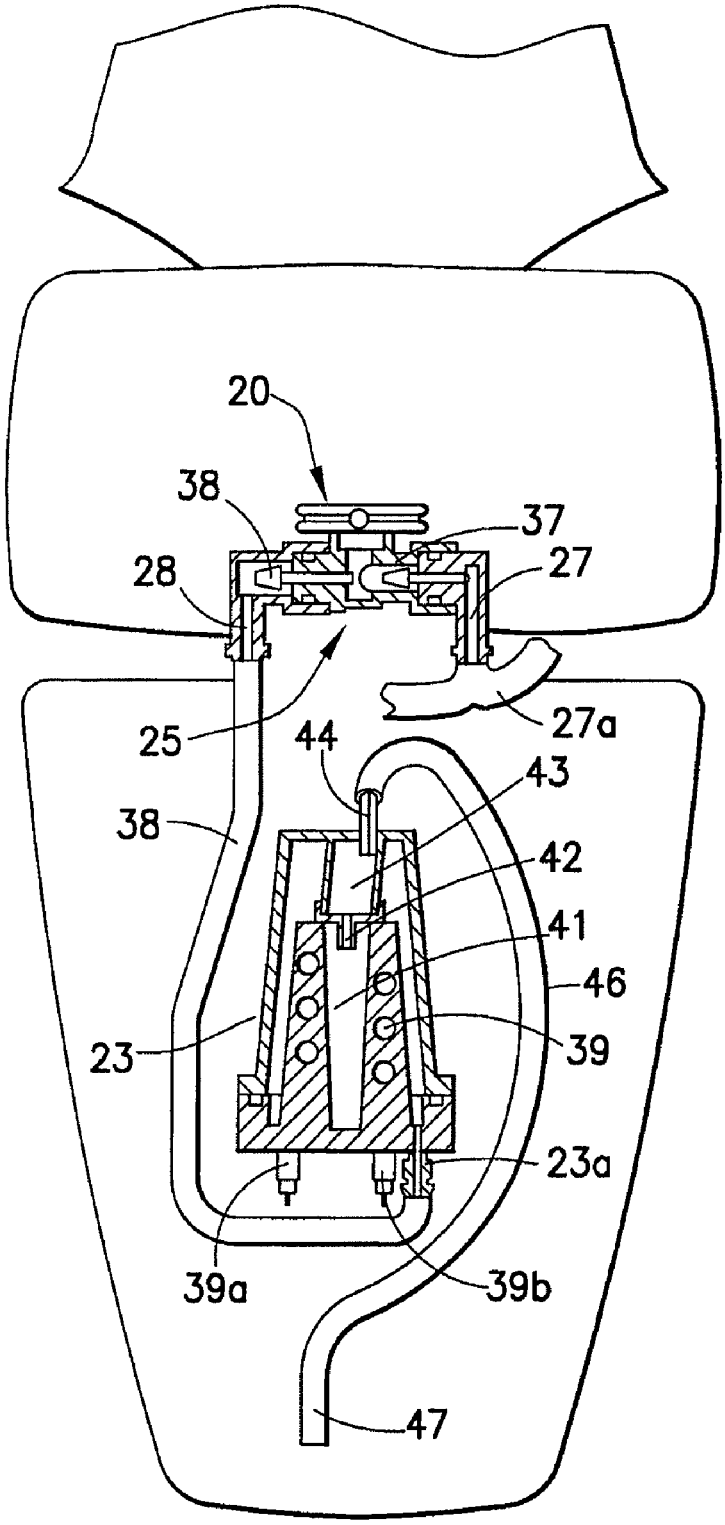
FIG. 3 is a front elevational view of the mop housing of FIG. 2 in section showing connections for the reservoir, pump and boiler and steam mop frame in accordance with one embodiment of the invention.

FIG. 3 is a front plan view in section showing the location of elements in housing 11. Water container 21 is positioned adjacent and surrounds a boiler 23. A one-way pump 25 pumps water from reservoir 21 to boiler 23 in response to the push-pull movement of mop 10.

Movement of mop 10 causes operation of one way pump 25 as will be described in detail below. Water is drawn from reservoir 21 into a water supply hose 21*a* that feeds into pump water inlet 27 through a one-way inlet valve 37 to a pump outlet hose 28. This water is then introduced into a boiler inlet 23*a* in boiler 23. Water in boiler 23 is heated by a heating element 39 in a boiler cavity 41. Heating element 39 is connected to electrical connectors 39*a* and 39*b*. Steam generated in boiler cavity 41 is fed through a steam valve 42 into a steam chamber 43. Steam is then expelled through a steam outlet 44 to a steam hose 46 and to a steam outlet fitting 47.

Figure 4:
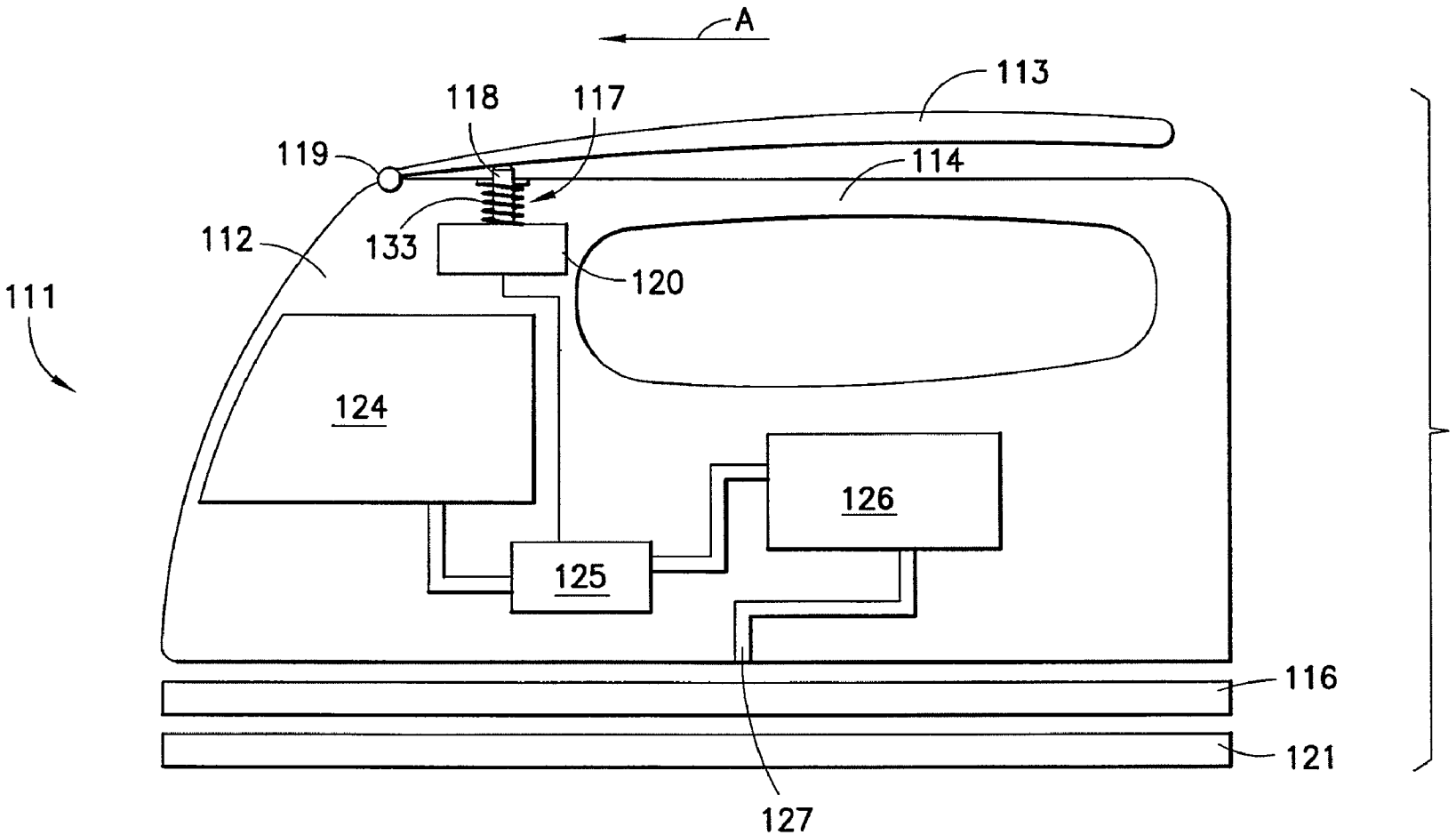
FIG. 4 is a schematic view of a steam appliance with an electrical pump and motion switch actuator positioned behind a handle lever in accordance with an embodiment of the invention.

A steam brush 111 in FIG. 4 has a housing 112 with a stationary handle portion 113 and a pivoting handle portion 114 and a steam frame 116 at the base of housing 112. A motion switch actuator 117 and a motion switch 120 is positioned at the top of housing 111 with an actuator post 118 operatively engaged with pivoting handle portion 113 mounted on housing 112 by a hinge 119. Steam brush 111 includes a water reservoir 124 connected to a steam generator 126 by a pump 125. Steam appliance 111 may be a hand steamer or a steam iron with a heated sole plate in place of frame 116.

A fabric steam towel or pad 121 may be mounted on steam frame 116 Here, when a user moves brush 111 in forward direction shown by an arrow A, handle extension 114 pivots about hinge 119 and presses on actuator post 118 overcoming the force of a spring 133 and post 118 contacts motion switch 120. This causes pump 125 to be actuated and water to be pumped from a water tank 124 to a steam generator 126 for feeding steam to steam frame or sole plate 116 trough steam outlet 127.

Figure 5:
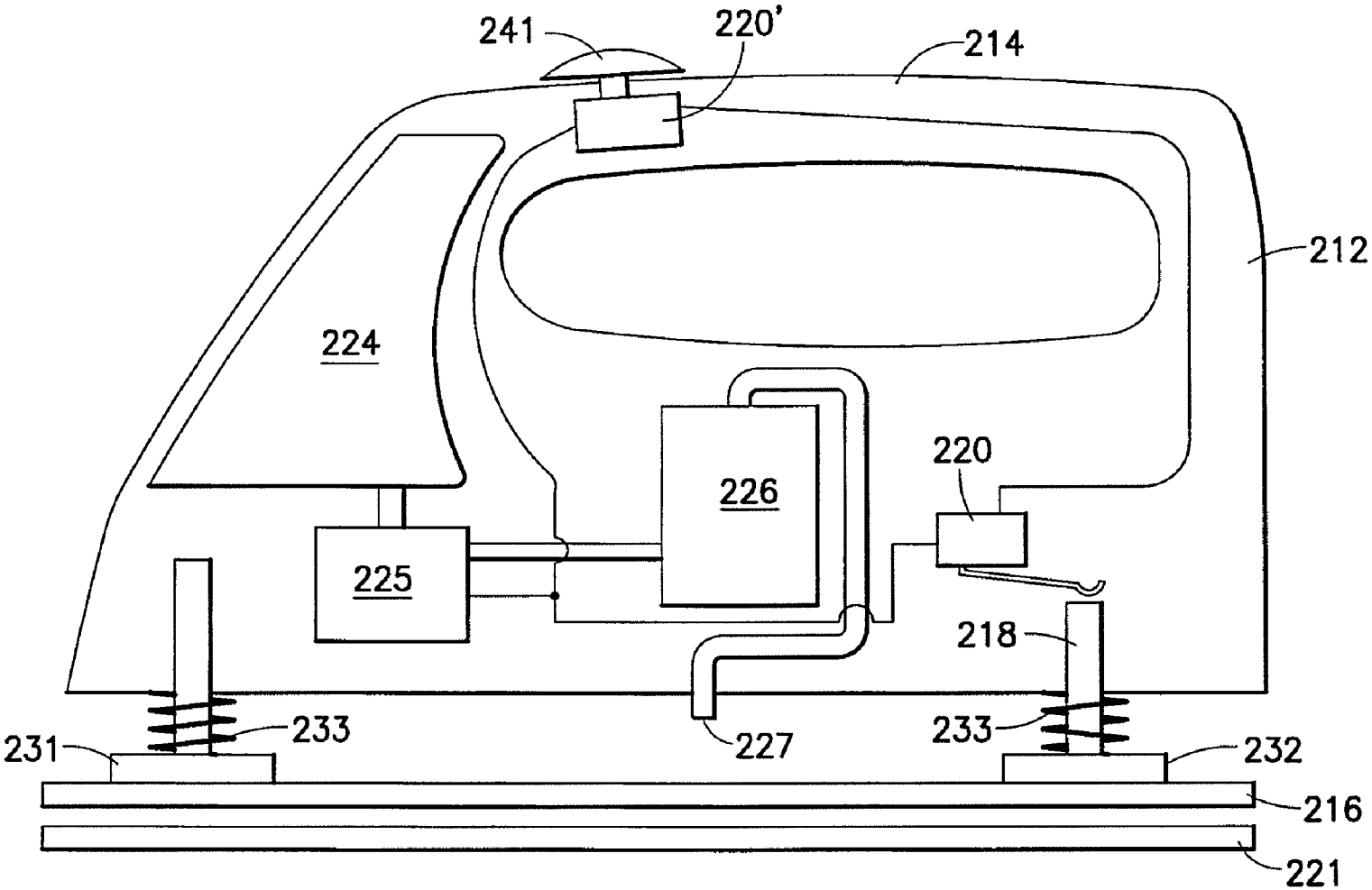
FIG. 5 is a schematic view of a steam appliance with an electrical pump in section with a handle having a pump button and a steam cleaning pad attached to two steam frame supports with one support operatively connected to a motion switch in accordance with another embodiment of the invention.

FIG. 5 is a schematic view of the elements of a steam brush 211 that include an electrical pump 225 with a steam frame 216. All elements in FIG. 4 appearing in FIG. 5 are identical and identified by element numbers with the addition of 100 to the element numbers. Towel frame or sole plate 216 is attached to housing 212 by a pair of frame supports 231 and 232 with springs 233 that keep motion switch 220 in an OFF position when appliance 211 is at rest.

Here, frame support 232 has motion switch actuator post 218. Once brush 211 is moved in any direction by a user to start the cleaning process, the weight of the user's hand and the force of pressure that user applies to brush 211 is great enough to overcome the force of spring 233 and to force steam frame 216 inward. This in turn forces frame support 232 inward with post 218 contacting a motion switch actuator 220*a* and placing switch 220 in the ON position. Turning motion switch 220 ON starts the water delivery to steam generator 226 by activating pump 225 causing water to be pumped to steam generator 226 and the steam generation process starts. Steam generator 226 is maintained hot from the moment when appliance 211 is plugged into a wall outlet to reduce delay time for generation of steam.

Once the steaming or cleaning process is stopped and appliance 211 is left without any excessive weight, motion switch turns pump 225 OFF. This interrupts water delivery into steam generator 226 and the steam generation process is stopped.

Steam brush 211 also includes a trigger 241 on handle 214 to activate pump 225 by turning on a secondary micro-switch 220'. Thus, electrical pump 225 is activated (1) when pressure is applied downward and frame support 232 is displaced to activate motion switch 220, or (2) when a user activates trigger 241 by moving appliance 111 to activate micro-switch 220'.

Figure 6:
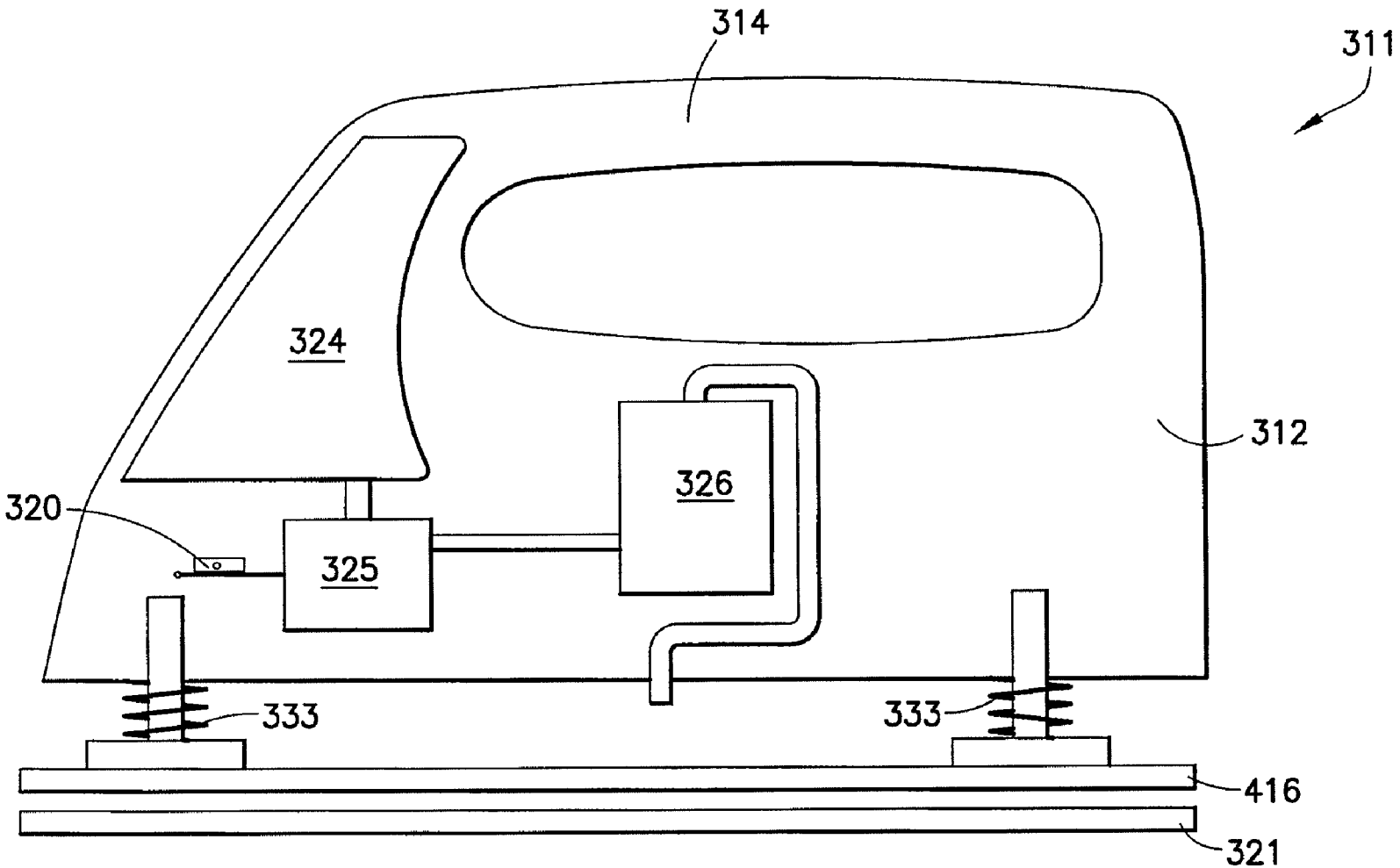
FIG. 6 is a schematic view of a steam appliance with an electrical pump in section with a handle and a steam cleaning pad attached to two steam frame supports with one support operatively connected to a motion switch in accordance with a further embodiment of the invention.

FIG. 6 is a schematic view of a steam brush or appliance 311 that includes a pump 325 and a motion switch 320. All elements in FIG. 6 are identical to appliance 211 in FIG. 5 except for the addition of 100 to the reference numerals. Towel frame or sole plate 316 is attached to housing 312 by a pair of frame supports 331 and 332 with springs 333 and 332 as in appliance 211 of FIG. 5.

Once appliance 311 is taken by a user to start the cleaning or steaming process, the weight of the user's hand and the force of pressure that user applies to appliance 311 is great enough to overcome the force of spring 333 and to force towel frame 316 inward which in turn forces actuator post 318 inward to actuate motion switch 320 connected to pump 325 causing water to be pumped to steam generator 326 and the steam generation process starts. Steam generator 326 is maintained hot from the moment when appliance 311 is plugged into a wall outlet to reduce delay time between uses.

When the cleaning process is stopped and device 311 is left without any excessive weight, springs 333 maintain appliance housing 312 at rest to maintain pump 325 in the OFF condition and no water is pumped to steam generator 326. This interrupts water delivery into steam generator 326 and the steam generation process is stopped. Mechanical pumps of the type shown in U.S. application Ser. No. 11/496,143 (now U.S. Application Publication No. US-2008-0236635-A1) and No. 11/769,521 (now U.S. Application Publication No. US-2008-0066789-A1) are suitable to use in appliances 11, 211 and if coupled to an electrical pump actuator. The contents of these applications are incorporated wherein by reference in their entirety.

Figure 7:
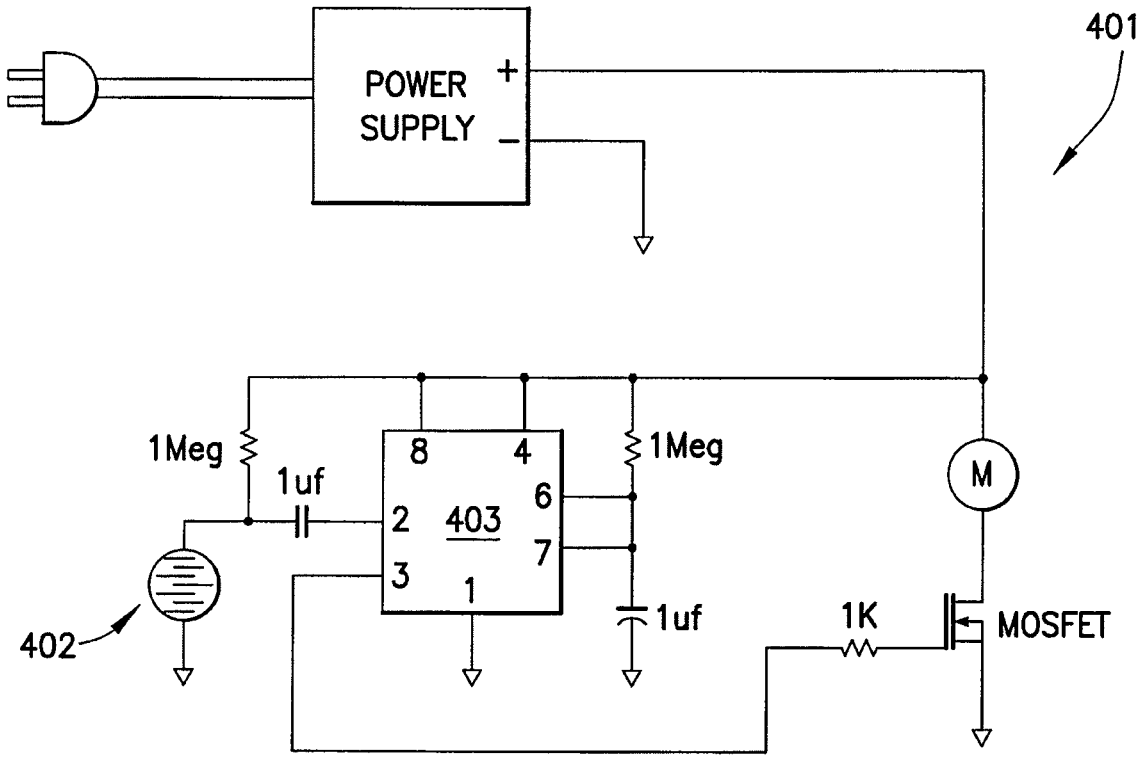
FIG. 7 is a timer circuit for use with motion switches for steam appliances in accordance with the invention.

FIG. 7 illustrates a circuit and appliance timer 401 suitable for use with pump 25 that is responsive to movement of an appliance by a user. Appliance timer 401 includes a motion switch 401 with a motion sensor 402 and a restartable timer IC 403 which is actuated when motion of the appliance is sensed by movement of a conductive element, such as a steel ball 405 in sensor 402. Steel ball 405 moving over a conductive etching pattern 404 or 406 on a base 407 in sensor 402 turns motor M on for a predetermined period of time. When the appliance is at rest and movement of ball 405 stops, the timer remains activated only for a preset time and then the pumping stops. One such restart timer that is suitable is a restart timer circuit available from Cana Kit Corporation in North Vancouver, British Columbia, Canada.

Figure 8A:
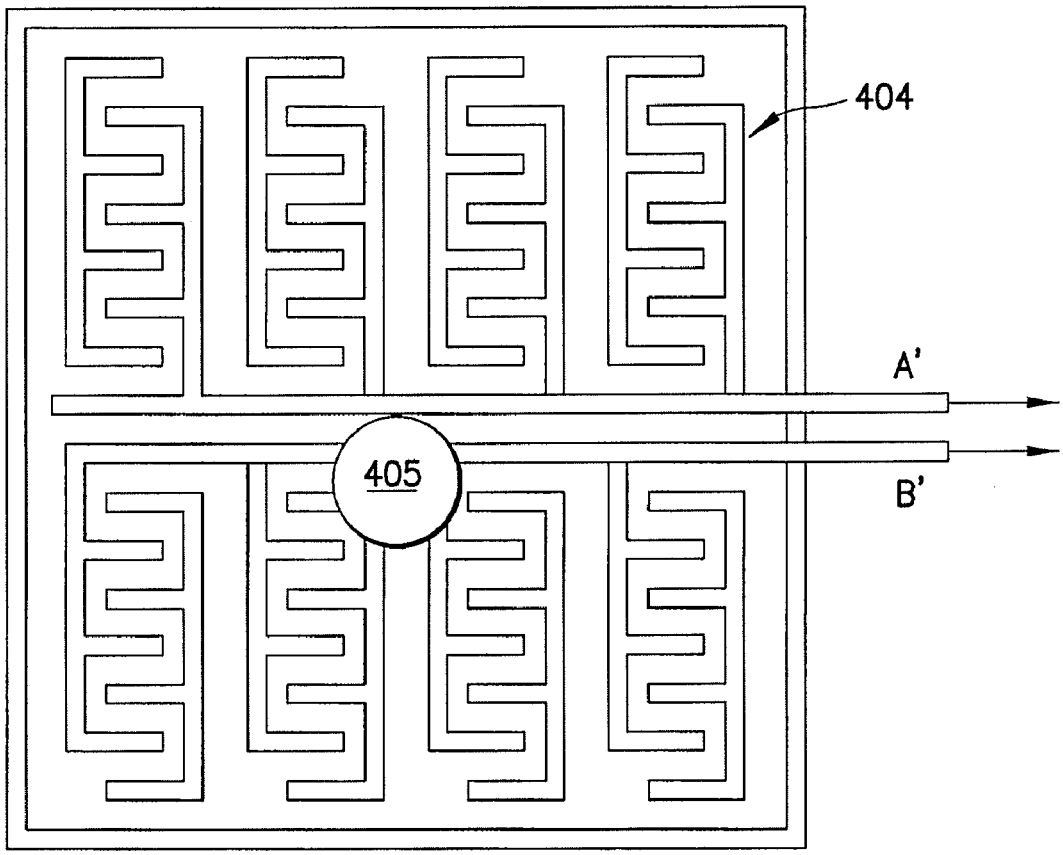
FIG. 8A is a plan view of a rectangular etching pattern for a motion detector switch for use in a steam appliance and FIG. 8B is an elevational view of the motion switch.
Figure 8B:
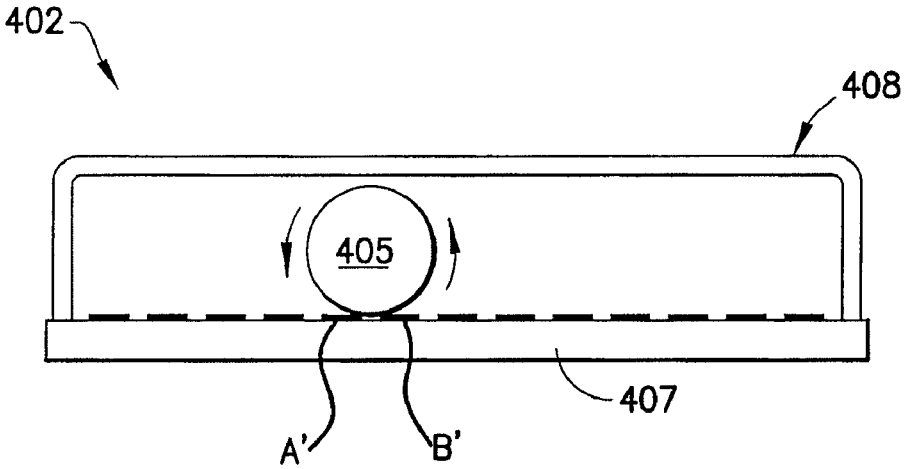
Figure 9A:
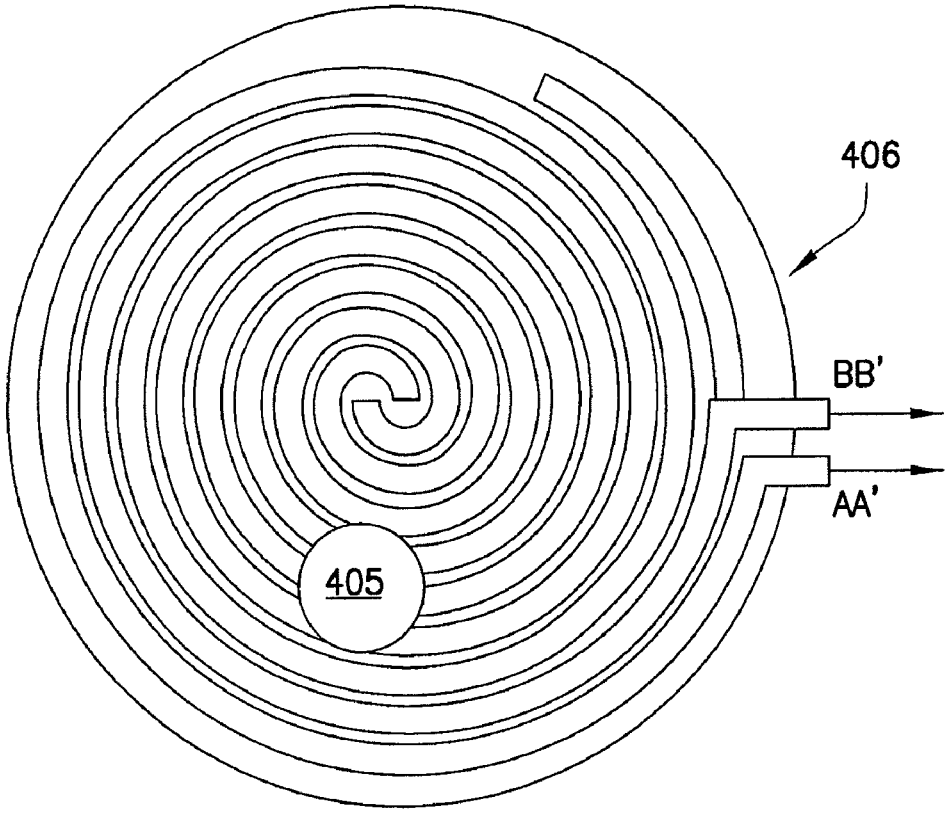
FIG. 9A is a plan view of a circular etching pattern for a motion switch for a steam appliance.
Figure 9B:
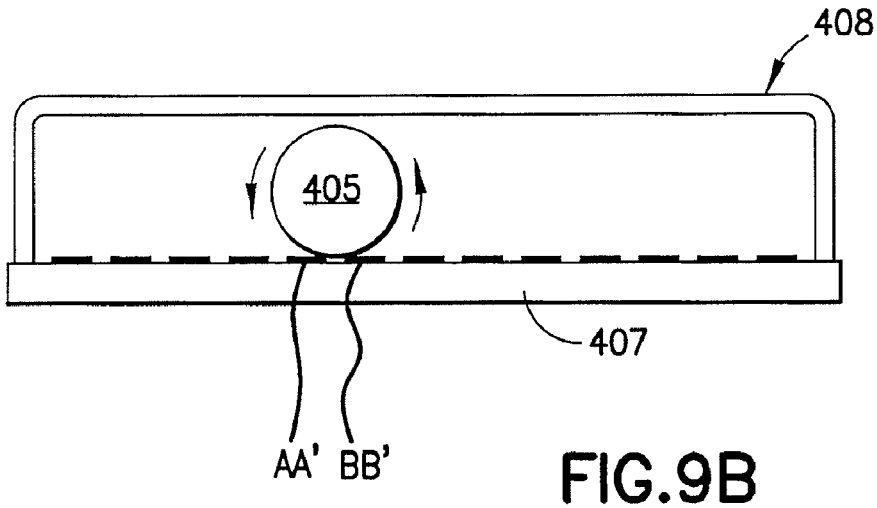
FIG. 9B is an elevation view of the motion switch.

Motion sensor 402 in motion switch 20 in appliance 10 is positioned adjacent to pump 25 and is responsive to movement of mop 10, or an appliance, such as steam brush 111, 211, or 311. Motion sensor 402 is shown in FIGS. 8 and 9 and may have a sensor housing cover 408 that is substantially rectangular or circular in shape on a base 407. Conductive etching pattern 404 or 406 is disposed on base 408 and includes a first conductive pattern A or AA and a second cooperating conductive pattern B or BB with conductive ball 405 resting on and traveling across base 407 when mop 10 is moved. Ball 405 contacts a portion of pattern A or AA and B or BB at all times due the intertwined etched patterns A and AA and B and BB as shown.

Etchings 404 and 406 are connected to terminals A and B or AA and BB, respectively and are electrically connected to timer circuit 403. When ball 405 is displaced by movement of mop 511 and comes to rest contacting a portion of pattern A or AA and B or BB, power is supplied to the timer circuit of FIG. 7. When timer circuit 403 is powered, water is pumped by from a reservoir to a steam generator for a preset period of time to supply steam to a steam frame through a steam outlet. So long as ball 405 moves across the conductive patterns, power continues to be supplied and water is pumped. When at rest timer circuit shuts the pump off and the steaming process ceases.

While motion sensor 402 is shown in connection with steam mop 10 and brush or iron 111, 311 and 311, it is within the scope of the invention to use a motion switch in any variety of steam appliance in place of micro-switches and the like. This provides a simplified mechanical structure for actuating of pumping and avoids the need for multiple micro-switches in many devices The timer circuit also insures that when the appliance is at rest in any orientation, pumping will cease at the selected time interval and steam generation will cease.

The steam appliances described provide many advantages for ease of use because they utilize either an electrical or a mechanical water pump with an automatic on/off switch to activate the water pump. In all the appliances, displacement of the appliance allows the user control over when water is to be discharged into the steam generator. Since the amount of water routed to the boiler is controlled, the boiler can create steam in a short amount of time. In each case, a fabric steam pad frame is typically placed over towel frame for effective steaming and cleaning.

It will thus be seen that the objects set forth above, among those made apparent from the preceding description, are efficiently attained and, since certain changes may be made in the above product without departing from the spirit and scope of the invention. It is intended that all matter contained in the above description and shown in the accompanying drawings shall be interpreted as illustrative and not in a limiting sense.

The present invention may be embodied in other specific forms without departing from the spirit or essential attributes of the invention. Accordingly, reference should be made to the appended claims as well as the foregoing specification, as indicating the scope of the invention.

What is claimed is:

1. A steam appliance, comprising:

an appliance housing, a water reservoir, a motion switch, a steam generator and a pump to pump water from the reservoir to the steam generator in the housing; the steam generator having a steam outlet; and a motion switch operatively connected to the pump; and a timer circuit electronically coupled to the motion switch and to the pump to pump water when the appliance is moved, and to continue pumping water for a preset time after movement of the appliance ceases.

2. The steam appliance of claim 1, wherein the motion switch includes a motion sensor.

3. The steam appliance of claim 2, wherein the motion sensor includes a conductive pattern and a conductive member that is displaceable across the pattern in response to movement of the appliance to reset the timer circuit.

4. The steam appliance of claim 3, wherein the conductive member is a metal ball.

5. The steam appliance of claim 1, wherein the appliance is a steam mop further comprising a steam mop head.

6. The steam appliance of claim 1, wherein the appliance is a steam brush further comprising a steam frame.

7. The steam appliance of claim 1, wherein the appliance is a steam iron further comprising a heated sole plate.

8. The steam appliance of claim 1, wherein the appliance includes an auxiliary switch to actuate the pump selectively by a user.

* * * * *